United States Patent [19]

Buchner

[11] 4,025,296

[45] May 24, 1977

[54] DEVICE FOR THERMICALLY TREATING GRANULAR AND/OR LUMPY MATERIALS

[75] Inventor: Heinrich Buchner, Niederkassel-Ranzel, Germany

[73] Assignee: Klockner-Humboldt-Deutz Aktiengesellschaft, Germany

[22] Filed: Oct. 17, 1973

[21] Appl. No.: 403,761

[30] Foreign Application Priority Data

Oct. 17, 1972 Germany ..... 2250830

[52] U.S. Cl. ..... 432/58; 34/57 R; 34/57 C; 432/106

[51] Int. Cl.² ..... F27B 15/00; F26B 17/00

[58] Field of Search ..... 432/14, 58, 106; 34/57 R, 57 A, 57 C

[56] References Cited

UNITED STATES PATENTS

| | | | |
|---|---|---|---|
| 729,008 | 5/1903 | Sutton et al. | 432/58 |
| 2,004,381 | 6/1935 | Middelboe | 432/14 |
| 2,590,090 | 3/1952 | DeVaney | 432/106 |

FOREIGN PATENTS OR APPLICATIONS

| | | | |
|---|---|---|---|
| 858,934 | 1/1961 | United Kingdom | 432/106 |

*Primary Examiner*—John J. Camby
*Attorney, Agent, or Firm*—Hill, Gross, Simpson, Van Santen, Steadman, Chiara & Simpson

[57] ABSTRACT

A device for treating granular or lumpy material by passing a gaseous medium therethrough characterized by a chamber having a material discharge device at the lower end and a material supply device comprising a pair of coaxially arranged supply channels at the upper end. The chamber has either a gas inlet or a plurality of burners to provide a gas flow through a portion of the material in the chamber and the material being added through the supply channels which are each connected to separate gas discharge conduits so that the material being added to the chamber is subjected to a uniform treatment by the gaseous medium.

13 Claims, 2 Drawing Figures

DEVICE FOR THERMICALLY TREATING GRANULAR AND/OR LUMPY MATERIALS

BACKGROUND OF THE INVENTION

The present invention is directed to a device for the thermic treatment of granular and/or lumpy materials, particularly calcite, limestone, dolomite or magnesite by means of a gaseous medium which enters a chamber and passes through the material being added to the chamber.

THE PRIOR ART

In French Pat. No. 1,344,599, a chute-preheater for granular and lumpy materials is disclosed. In this device, material is guided downwardly into a chute consisting of two chambers and is permeated by hot furnace exhaust gases which are flowing in the opposite direction. In order to prevent an edge passage of the hot gases in the chute, a central gas conduit is arranged in the chute which conduit is provided with outlet openings in the area of the chamber. However, the structure of this device does not enable a uniform guidance of the individual gas currents through the material and thus does not enable a uniform thermic treatment of the material in the device.

SUMMARY OF THE INVENTION

The present invention is directed to a device for thermically treating granular and lumpy materials which device enables a simple, economical and uniform thermic treating of the materials. To accomplish this task, the material charging means for the chamber is divided into at least two material supply channels with each supply channel being attached to a separate gas discharge conduit. The provision of at least two material supply channels enables the separate charging of at least two different classes or sizes of granular and/or lumpy materials. Since each of the material supply channels is provided with a separate gas outlet conduit, the flow of the gaseous medium through the material in each of the channels can be controlled to obtain a sufficient quantity of gas acting on the material in each channel and thereby obtain an optimum distribution of the quantities of gas for the individual classes of grain size of the material in the chamber. The provision of at least two separately arranged material supply channels also enables a uniform distribution of the material being charged into the chamber without requiring special distributing devices.

An advantageous embodiment of the invention has each of the material supply channels extending or projecting into the chamber to a different degree of distance. In this way, particularly, through filling of the channels with different classes of grains, and exact adaptation of the gas feed to the corresponding passage resistance of material in each channel is obtained. In a preferred embodiment, the material supply channels are constructed to extend coaxially with one another in such a manner that between the outer wall of the inner material channel and the inner wall of the outer material channel, an annular or ring-shaped channel is formed. This arrangement of coaxial channels enables the obtaining of a symmetrical material distribution in the chamber particularly when the chamber is supplied with different classes of grain size. Also, the arrangement enables the obtaining of a favorable gas flow condition through the various types of material in the chamber.

To facilitate the control of the gas flow, each of the gas discharge conduits which are attached to the material channels are provided with separate throttle members or valves. By controlling the setting of the throttle members, gas flow conditions may be imposed onto the gas quantity distribution independent of the pressure resistance in the granular and lumpy material so that for example, only one exhaust gas driven compressor is necessary to supply the gaseous medium.

To improve the flow of gas in the inner channel, the lower wall area thereof is provided with openings for the lateral gas supply to the interior of the channel. The inner channel is supported in the chamber by support members having a roof-shaped cross section which are distributed around the circumference of the inner channel and extend downward to the chamber wall at an angle which is parallel to the angle of respose or angle of inclination of the material deposited in the chamber. Each of the roof-shaped support members is connected to one of the openings in the inner channel wall and is spaced from the surface of the material deposited in the chamber a distance smaller than the distance from the discharge end of the outer channel to the gas discharge conduit associated therewith.

In order to be able to regulate the height of the loose or bulk material in the inner channel, the material supply channel is provided with an inlet pipe which discharges into the inner channel and is arranged to be adjustable as to heighth. By means of the adjustable material feed pipe, a gas quality distribution in the channel can be controlled to compensate for different pressure resistance in the material being introduced through the inner channel.

DESCRIPTION OF THE PREFERRED EMBODIMENTS

Figure 1:
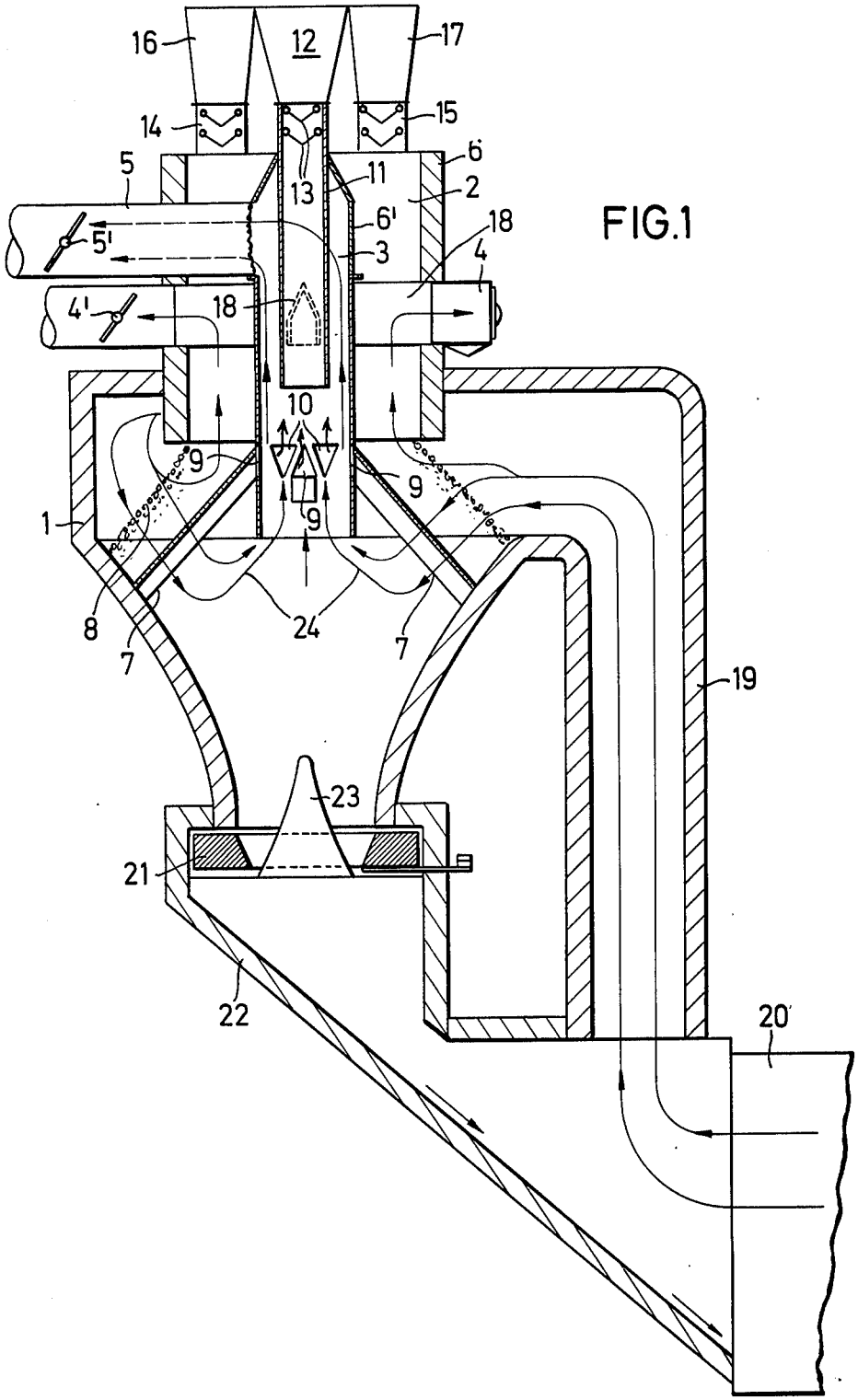
FIG. 1 is a cross-sectional view with portions in elevation for purposes of illustration of a device according to the present invention.

The principles of the present invention are particularly useful in a device for thermically treating granular and/or lumpy material. An illustrative embodiment of the device incorporating the principles of the invention is a charging chute preheater having a vertically arranged chamber 1 which receives material which is thermically treated and/or preheated prior to being discharged into a subsequent treatment device which is a rotary kiln 20.

The chamber 1 has a continuous wall which has a cylindrical portion adjacent an upper end and which wall converges inwardly or conically to a lower end which receives means for discharging material from the chamber 1 into a closed chute or conduit 22 that conveys the material to the kiln 20. The discharge means includes a mechanically driven material discharge ring or device 21 which has an aperture that receives a cone or pin 23 to improve the material distribution of the material being discharged from the chamber 1.

To charge material into the chamber 1 and to provide an exhaust for the treatment gases, means including a pair of coaxial material supply channels 2 and 3 are mounted on an upper end of the chamber 1. The supply channel 2 has a wall 6 which extends into the chamber 1 and is connected to a gas discharge conduit 4 which removes gases from the channel 2. The channel 3 is formed by a cylindrical wall 6' which is connected to a gas discharge conduit 5 and which wall 6' extends into the chamber 1 a distance greater than the wall 6. As illustrated, the channel 2 has an annular configuration which is defined by the walls 6 and 6'.

The channel 3 formed by the cylindrical wall 6' is supported coaxially in the wall 6 of the channel 2 by a plurality of supports 7 which have a roof-shaped or channel-shaped cross section. The supports 7 are uniformly distributed around the circumference of the wall 6' with the open side extending downward into the chamber 1 and the supports, which are attached to the conical or converging wall of the chamber 1, extend at an angle to the axis of the channel 3. The angle of the supports 7 is approximately parallel to the angle of repose or the inclined angle of the surface 8 of a conical pile of the material deposited in the chamber 1 through the channels 2 and 3. Each of the supports 7 at an upper end is connected or in communication with an opening 9 in the wall 6' of the channel 3. Furthermore, the lower area of the wall 6' forming the channel 3 is provided with additional openings such as 10 to allow lateral entry of gas into the channel.

To introduce or charge material into the channel 3, the channel is provided with a feed pipe 11 which extends into the upper end thereof. The inlet or feed pipe 11 is attached to a material receiving pipe 12 which is constructed to have an upwardly opening funnel shape. The material feed pipe 11 is provided with gas impermeable material charging valves or locks 13 which may be a pair of valve locks which permit downward delivery of material through the pipe 11 while preventing the escape of gas through the pipe. The feed pipe 11 is adjustable positioned along the axis of the channel 3 to control the heighth of material being added to the channel.

To charge material into the ring or annular channel 2, the upper end is provided with several pipes 14 and 15 with corresponding feed charging valves and with material receiving pipes 16 and 17. In order to obtain a uniform distribution of material on all sides of annular or ring channel 2, it is suitable to arrange more than two material receiving pipes uniformly around the periphery or circumference of the ring or annular channel 2.

To facilitate flow of gas in the channel 2 into the gas discharge conduit 4, a plurality of gas conduit elements 18 which have a roof-shaped cross section extends radially from the wall 6' of the inner channel 3 to the wall 6 of the annular channel 2. Each of the gas conduit elements 18 are connected through appropriate apertures to an annular ring of the gas dishcarge conduit 4. To control the rate of flow through the discharge conduits 4 and 5, each discharge conduit is provided with a throttle member or valve 4' and 5', respectively. Each of these valves 4' and 5' can be individually controlled to vary the rate of flow through the respective conduits.

In the device illustrated in FIG. 1, the gaseous medium is supplied by a hot gas conduit 19 which is connected to the rotary kiln and discharges hot exhaust gases centrically into the upper portion of the chamber. The hot gas conduit 19 may be advantageously arranged to discharge tangentially in the chamber 1 whereby a uniform distribution of gas through the inlet housing extends spirally or helically to the axis of the chamber.

In operation of the device of FIG. 1, which may be a chute preheater, the material receiving pipe 12 is provided with lumpy material, for example of grain size of approximately 25 to 45 mm. This material is charged through the material feed pipe 11 into the inner material supply channel 3. Granular material, for example of grain size approximately 10 to 25 mm, is charged through the material receiving pipes 16 and 17 into the annular channel 2. The material in the channels 2 and 3 flow into the chamber 1 and form a conical pile with an incline surface 8. Due to the extension of the wall 6 into the upper portion of the chamber 1, the surface 8 is spaced below the upper surface or wall of chamber 1 and thus the chamber 1 has an annular chamber or portion which is free of material. As the gas from the hot oven or furnace exhaust gases such as from the kiln 20 are introduced through the conduit 19, they flow in the annular portion above the conical pile and then through the material in a countercurrent manner to be exhausted through the discharge conduits 4 and 5. As illustrated, a portion of the gas flows through the material being introduced through the channel 2 and the remaining portion flows in a direction of arrows 24 and passes through the open end of the channel 3 as well as through the openings 9 and 10 in the channel wall 6'. After flowing through of the channel 3, the gas will be exhausted by the conduit 5.

Due to the manner of charging material into the chamber 1, the lumpy material enters the chamber 1 centrally through the material supply channel 3 and a loose material cone or pile with relatively large cavities is formed in the chamber. The flow of gases through this material is favored by the outer loose granular material of the cone or pile. Furthermore, by means of the support 7 which has the roof-shaped cross section that are directed with the open edge or opening towards the bottom of the chamber 1 and extend parallel to the conical surface 8, the flow of gas into the channel 3 is promoted. This flow starts at the surface of the cone of material and flows through the material of the cone along the supports which serve as channels for passing the gas into the interior of the channel 3. In this manner, a uniform gas distribution over the entire cross section of the loose material of the cone and therefore a uniform thermic treatment of the granular and lumpy material reaching the cone is obtained. The support 7 advantageously promotes distribution of gas in the cone of loose material and also serve as gas conducting elements to direct a flow to the interior material supply channel 3.

By adjusting the throttle members 4' and 5' provided in the gas discharge conduits 4 and 5, respectively, the distribution of the quantity gas may be optimally adjusted under consideration of the pressure resistance in both the granular and lumpy materials. With the aid of the separately arranged discharge conduits 4 and 5, a particular favorable gas conduction and impingement of the gases on the inner part of the cone of loose material is made possible. In this manner, a very uniform heating of the material in the chamber is obtained regardless of the grain size of the material being treated.

Due to the spacing of the gas discharge conduit from the lower edge of the wall 6 of the channel 2 being greater than the spacing of the support 7 from the incline surface 8 of the cone, a pressure resistance to gas flow in the material contained in the ring-shaped channel 2 is higher than the pressure resistance to a flow of gas through the material between the incline surface 8 and the support 7. The flow of the stream of the gases into the interior portion of the cone of material is very effectively supported by means of the outer layer of granular material.

By adjusting the height of the material feed pipe 11, the height of the loose material in channel 3 may be altered or changed. In this manner, control of the flow through the material in the channel 3 can be adjusted for considerations of pressure resistance of the granular and/or lumpy materials contained in the channel 3.

The thermically pretreated material in chamber 1 is continuously conveyed downward through the chamber with the aid of the material discharge means such as the ring 21. Furthermore, through the conical construction of the lower part or portion of the chamber, a uniform shrinking of the column of material formed in chamber 1 is very advantageously effected. Therefore, with the aid of the material discharge device, the amount of material discharged may be varied according to the desired output. By controlling the rate of discharge from the chamber 1, the time or duration for which the material is subjected to the treatment gases can be controlled.

The device shown in FIG. 1 according to the present invention is constructed as a chute preheater which is used in conjunction with a rotary kiln 20 which supplies exhaust gases through conduit 19. In this arrangement, the chute preheater supplies a large continuous flowing output capacity. With lower output capacity requirements, a device illustrated in FIG. 2 can be utilized to provide an independent oven for the burning or firing of granular and lumpy materials. With the utilization of the device according to the present invention as a burning oven or calcining kiln, burners 25 are distributed uniformly on the periphery of the wall of the chamber, which becomes a combustion chamber, with the burner openings or discharge being above the level of the cone of the material in the chamber. In order to bring about a uniform heating of the lump and granular material in the chamber, it is suitable to convey the lumpy material through the ring channel and the granular material through the inner channel to the combustion chamber. The fuel preferably in a gaseous condition and the air required for the combustion of the fuel is introduced through the burners 25 into the chamber and brought into combustion in the cavity or spaced located between the pile of material and the chamber wall.

In some treatment procedures, instead of completely burning the fuel introduced through the burners 25 in the area outside of the loose pile of material, it may be desirable to complete the combustion of the fuel in the middle or center portion of the loose material cone or pile. This is attained in a simple manner by controlling the supply of oxygen being mixed with the fuel as it is introduced by the burners 25 so that complete combustion is not attained. The remaining oxygen necessary for a complete combustion of the fuel, which is introduced by the burners into the combustion chamber, is supplied in the form of cooling air to a ring conduit 26 which is connected with a corresponding opening in the chamber wall in the lower area of the device. The cooling air supplied in the lower area through the cooling air conduit 26 serves to cool the completely burned material which is adjacent the discharge opening and then rises centrally in the chamber through the loose material cone and encounters the hot gases flowing inwardly on all sides of the pile. As the cooling air comes in contact with the incompletely burned fuel, complete combustion is attained. A uniform heating of the material in the furnace or kiln by this process will again be determined by the composition of the material. The material burned to a finish in the kiln or furnace and cooled in the lower area is discharged through the discharge means in a well known manner, and, if necessary, is substantially cooled in a separate cooler connected in series therewith.

Figure 2:
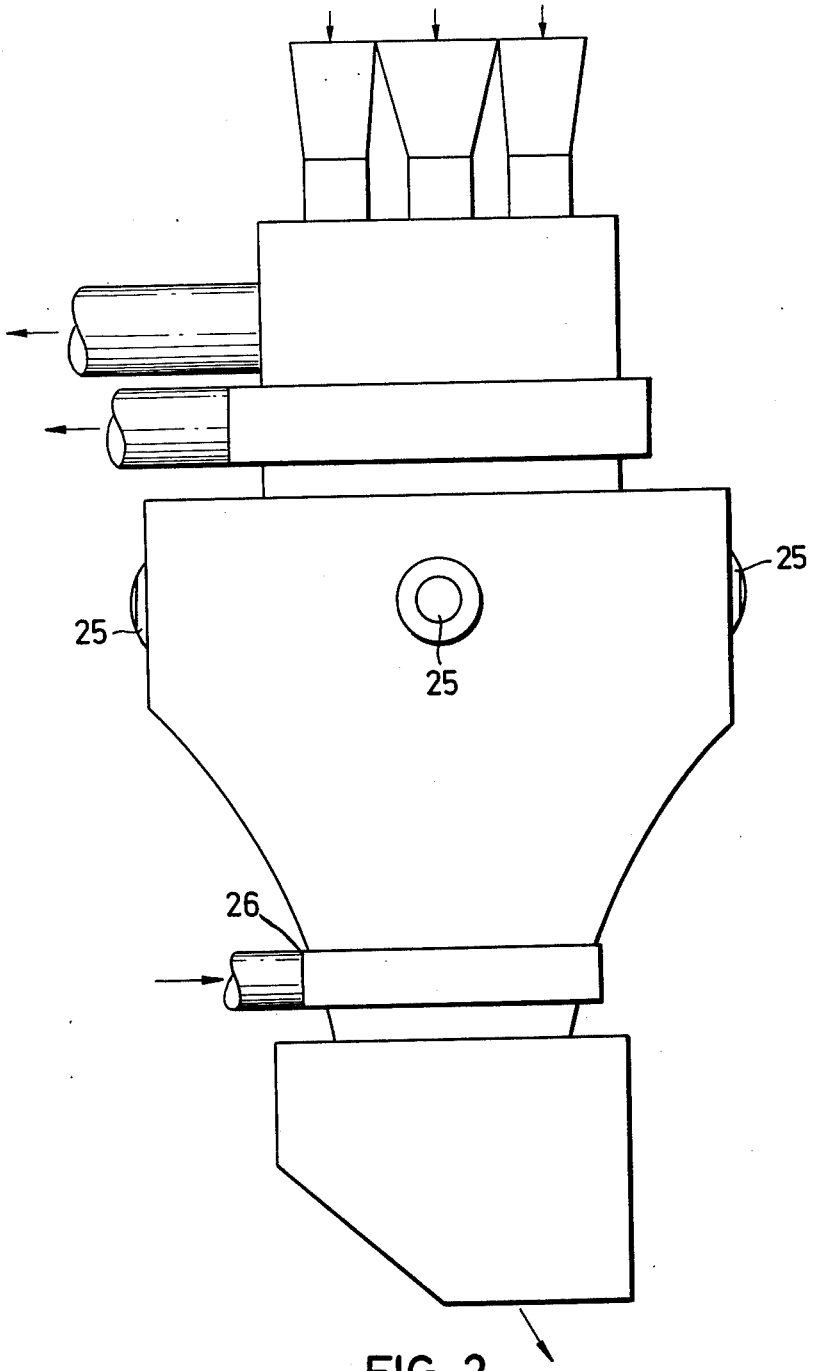
FIG. 2 is a side view of an embodiment of the device of the present invention constructed as a burning oven or kiln.

The device, as shown in FIG. 2, may also be used to cool hot loose or bulk material. For this purpose, the burners 25 which are arranged in the wall of the chamber are removed and the chamber at these points is supplied with cooling air. In addition, the chamber and the material supply channel which are illustrated in FIGS. 1 and 2 may be constructed with a quadrangular or rectangular cross section. The subject matter of the invention is therefore, with respect to the construction of the chamber and material feed, not limited to the specific devices illustrated in FIGS. 1 and 2 which devices are illustrative examples of embodiments of devices using the principles of the present invention.

Although various minor modifications might be suggested by these versed in the art, it should be understood that I wish to employ within the scope of the patent granted hereon all such modifications as reasonably and properly come within the scope of my contribution to the art.

I claim:

1. A device for thermically treating a granular and lumpy material such as calcite, limestone, dolomite, and magnesite by passing a gaseous medium therethrough, said device comprising a chamber having an upper end and a lower end, said chamber having at least one wall extending between said ends with at least one opening for admitting a gaseous medium into the chamber adjacent the upper end, means for supplying material to the chamber and for removing the gaseous medium therefrom, said means being mounted on the upper end of the chamber, and means for discharging material from the chamber mounted at the lower end of the chamber, said means for supplying material including at least two material supply channels with each of said supply channels being connected to a separate gas discharge conduit, each of the material supply channels extending into the chamber with one of the material supply channels extending further than the remaining channels so that a portion of the gaseous medium passes down through the material which had been supplied by the remaining channels and then through said one channel.

2. A device according to claim 1, wherein each of the gas discharge conduits connected to the material supply channels includes a throttle member.

3. A device according to claim 1, wherein the wall of the chamber has a plurality of openings uniformly distributed therearound at a position disposed adjacent the level of the end of the remaining channels extending into the chamber, each of said openings receiving means supplying a gaseous medium.

4. A device according to claim 3, which further includes an additional opening in the wall of the chamber above the material discharge means for feeding cooling air into the material contained in the chamber.

5. A device according to claim 3, wherein each of the means supplying a gaseous medium includes a burner for creating the gaseous medium.

6. A device according to claim 5, which further includes an additional opening in the wall of the chamber above the material discharge means for feeding cooling air into the material contained in the chamber.

7. A device according to claim 1, wherein a material feed pipe extends into said one channel for discharging material thereto, said material feed pipe being adjustably positioned in said one channel to control the height of material received therein.

8. A device for thermically treating a granular and lumpy material such as calcite, limestone, dolomite, and magnesite by passing a gaseous medium therethrough, said device comprising a chamber having an upper end and a lower end, said chamber having at least one wall extending between said ends with at least one opening for admitting a gaseous medium into the chamber adjacent said upper end, means for supplying material to the chamber and for removing the gaseous medium therefrom, said means being mounted on the upper end of the chamber, and means for discharging material from the chamber mounted at the lower end of the chamber, said means for supplying material including at least two material supply channels extending into said chamber with each of said supply channels being connected to a separate gas discharge conduit, the material supply channels being coaxially arranged with respect to one another with the outer wall of the inner supply channel and the inner wall of the outer supply channel forming an annular material supply channel so that a portion of the gaseous medium passes through the material which is supplied by the outer supply channel and then through the inner channel.

9. A device according to claim 8, wherein the inner material supply channel extends into the chamber a greater amount than the outer material supply channel.

10. A device according to claim 9, wherein the wall of the inner material supply channel adjacent a lower end thereof is provided with openings to enable a lateral entry of the gaseous medium into the interior of the inner material supply channel.

11. A device according to claim 10, wherein the lower end of the inner material supply channel is supported relative to the chamber by a plurality of supports uniformly distributed around the periphery of the inner channel, each of said supports having a roof-shaped cross section and being arranged with the open side thereof extending downward, each of said supports being connected adjacent one of said openings in the wall of the inner channel and the supports extending at an angle to the axis of the channel which angle is parallel to the angle of repose of the material in said chamber.

12. A device according to claim 11, wherein the gas discharge conduit for the outer supply channel is spaced from the end of the wall forming the outer channel a greater distance than the distance of the end of the outer channel from the supports.

13. A device for thermically treating a granular and lumpy material such as calcite, limestone, dolomite, and magnesite by passing a gaseous medium therethrough, said device comprising a chamber having an upper end and a lower end, said chamber having at least one wall extending between said ends with at least one opening for admitting a gaseous medium into the chamber adjacent said upper end; means for supplying material to the chamber and for receiving the gaseous medium therefrom, said means being mounted on the upper end of the chamber, said means for supplying material including at least two material supply channels extending into said chamber with each of said supply channels being connected to a separate gas discharge conduit, said material supply channels being coaxially arranged relative to one another so that one of the channels is an annular-shaped channel surrounding the wall forming the other channel; means for discharging material from the chamber mounted at the lower end of the chamber; and a material feed pipe extending into the other channel for discharging material thereto, said material feed pipe being adjustably positioned in the other channel to control the height of material received therein so that a portion of the gaseous medium passes through the material which is supplied by the annular-shaped channel prior to entering the other channel.

* * * * *